United States Patent [19]

Hirsch

[11] 4,344,733

[45] Aug. 17, 1982

[54] HYDRAULIC CONTROL CIRCUIT FOR DECELERATING A SWINGING BACKHOE

[75] Inventor: Arthur E. Hirsch, Terre Haute, Ind.

[73] Assignee: J. I. Case Company, Racine, Wis.

[21] Appl. No.: 76,165

[22] Filed: Sep. 17, 1979

[51] Int. Cl.[3] ..... B66C 23/00

[52] U.S. Cl. ..... 414/694; 91/395; 414/695.5

[58] Field of Search ..... 91/394, 395, 396, 451, 91/452; 180/139; 280/6.11, 707; 212/245; 414/687, 694, 695, 695.5, 744 R

[56] References Cited

U.S. PATENT DOCUMENTS

| | | | |
|---|---|---|---|
| 3,488,954 | 1/1970 | Thomas et al. | 114/150 X |
| 4,065,010 | 12/1977 | Worback | 414/694 |
| 4,138,928 | 2/1979 | Pilch | 91/395 X |

*Primary Examiner*—John J. Love
*Assistant Examiner*—R. B. Johnson
*Attorney, Agent, or Firm*—Dressler, Goldsmith, Shore, Sutker & Milnamow, Ltd.

[57] ABSTRACT

A hydraulic actuator and control for positioning the boom of a backhoe mounted on the rear of a tractor that smoothly decelerates the boom at the limits of its horizontal swinging movement. A directional control valve ports fluid to two double acting hydraulic actuators positioned in opposed relation on the tractor to drive the boom from side to side. The boom is cushioned at the limits of its travel, whether or not the operator releases the operating pedal for the directional control valve, by blocking discharge flow from a contracting actuator to the directional control valve and porting this discharge flow over a pressure relief system that is independent of the directional control valve. The pressure relief system provides substantially constant deceleration of the boom without high peak pressure in the actuator by using a lower pressure relief valve in the actuator cylinder heads arranged in series with a higher pressure relief valve that discharges directly to tank. The higher pressure relief valve also cushions the boom during mid-stroke stopping by an interconnection with the main fluid lines between the directional control valves and the actuators.

3 Claims, 2 Drawing Figures

HYDRAULIC CONTROL CIRCUIT FOR DECELERATING A SWINGING BACKHOE

BACKGROUND OF THE PRESENT INVENTION

The problem of adequately cushioning the stopping movement of the boom of a backhoe has been present for decades.

A conventional backhoe includes an articulated boom mounted on the rear of a tractor carrying a pivotal bucket for the digging operation. The boom is mounted on a mast for pivotal movement about a vertical axis so that a filled bucket may be swung away from the operating area. The mast swings from side to side by opposed double acting hydraulic actuators controlled by a directional control valve.

Backhoes are employed to excavate for building foundations, pipe laying or similar operations. The operation of excavating is a highly competitive one and therefore, any means whereby the work can be more efficiently performed is desirable. One way to increase efficiency is to shorten the time cycle involved in filling the bucket, raising it out of the excavation, swinging the bucket laterally, depositing the material on a pile or into a truck, and returning to repeat the cycle. With conventional hydraulic arrangements employed prior to the 1960's to rotate the mast of a backhoe, it was the usual practice of operators, in order to save time, to swing the mast over hard againt the stops and the frame when preparing to dump the load. This practice was found detrimental because the frame, the masts and the hydraulic circuit were subjected to severe shocks. While these shocks may be avoided by carefully manually manipulating the controls, this practice is time consuming and therefore slows down the work.

In an attempt to reduce this problem, various systems have been devised to decelerate the boom prior to hitting the stops even though the operator does not attempt to reduce the speed of the boom.

One prior method of cushioning movement of the boom and mast as they approach the stops includes blocking flow from the actuators and porting this flow over a pressure relief valve mounted in the actuators which discharges into the main hydraulic lines connecting the directional control valve with the actuators. Flow discharging through the main lines is blocked by a projection carried by the piston that enters and blocks flow in an actuator outlet port. This projection is commonly referred to as a "stinger." In this system it is also necessary and desirable to cushion stopping the boom during midstroke stopping and to achieve this two secondary relief valves are connected to the main hydraulic lines so that if the operator rapidly moves the directional control valve in midstroke to a neutral blocking position, peak pressure in the actuators will be limited by these relief valves to reduce the shock.

One problem with this system occurs when the operator attempts to assist the stopping of the boom at the end of its swing by releasing his foot pedal, which moves the directional control valve to a neutral blocking position. In this position, fluid discharging over the cylinder mounted relief valve cannot exit through the main hydraulic line over the directional control valve and must pass through one of the secondary relief valves. This has the effect of putting the relief valves in series under this specific condition. When the operator does not attempt to assist the stop, and leaves the pedal depressed, flow from the cylinder mounted relief valve passes freely over the directional control valve bypassing the second relief valves. The cylinder relief valve must therefore be a high pressure relief valve because it has to be capable of providing an adequately cushioned stop even when the operator does not attempt to assist the stop, and this frequently occurs. Therefore, when the operator does attempt to assist the stop, two high pressure relief valves act in series producing undesirably high peak pressure in the actuators. Moreover, because restrictors are provided in the main discharge lines, they provide a cumulative effect with the pressure relief valves to increase peak actuator pressure. These peak pressures have been found to be in excess of 8000 pounds per square inch at low temperatures.

Ideally, it is desirable to maintain a constant pressure in the cylinder during deceleration, since this permits a much lower peak pressure than provided with a deceleration system such as this prior one that provides an upwardly extending spike-like pressure curve, having pressure on the ordinate (vertical coordinate) and boom swing angle on the abscissa (horizontal coordinate), with the same cushioning effect. Another problem in this prior system is that because the cylinder relief valve is a high pressure relief valve, prior art practice has introduced a leakage path between the stinger and its outlet port. This annular orifice is temperature sensitive and the peak pressure varies significantly with temperature, an undesirable characteristic.

It is therefore a primary object of the present invention to ameliorate these problems in prior art systems for controlling the positioning of a backhoe boom.

SUMMARY OF THE INVENTION

In accordance with the present invention a hydraulic control and deceleration system is provided for the swinging movement of the boom of a backhoe that reduces peak pressures in the boom swing actuators, and eliminates the effect of the operator attempting to assist stopping the boom near the end of its swing.

Two opposed actuators for positioning the boom have conical ports in their head ends that receive "stingers" or projections carried by the pistons as the pistons reach their end of stroke at the head end of the cylinders similar to the prior system described above. This blocks flow discharging from the actuators through the main hydraulic lines to the directional control valve. As pressure increases in the contracting head end chamber as normal discharge flow is blocked, a relatively low pressure relief valve mounted in the head end opens. This pressure relief valve has a pressure setting less than one half the prior art cylinder pressure relief valves, and this reduces the change of relief pressure with flow for the inexpensive relief commonly used assisting in producing a lower peak pressure since pressure drop through the relief valve does not vary as much.

The lower pressure cylinder relief valve is possible, while still providing adequate cushioning, through the provision of a secondary high pressure relief valve isolated in series with the cylinder relief valve completely bypassing the directional control valve. In this way end of stroke deceleration is always provided by the cumulative effect of the lower pressure cylinder relief valve and the high pressure secondary relief valve regardless of what the operator does to the directional control valve.

This system has the additional advantage of substantially eliminating the temperature sensitivity of prior designs, i.e., the increase of peak cylinder pressure with decreasing temperature.

The secondary high pressure relief valve also acts to decelerate the boom when the operator releases the foot pedal in mid-stroke. When the operator moves the directional control valve to a blocking neutral position in mid-stroke, pressure increases in the discharging one of the main hydraulic lines. This increase of pressure is relieved by flow through a check valve to the secondary relief valve cushioning the stopping movement of the boom. Separate lines and check valves connect each of the two main lines to secondary relief valve so that it performs the function of two relief valves.

BRIEF DESCRIPTION OF THE PREFERRED EMBODIMENT

FIG. 1 is a side view, partly broken away, showing the rear end of a tractor with a conventional articulated backhoe boom and bucket mounted for swinging movement on the rear end of the tractor, and FIG. 2 is a hydraulic control circuit for positioning two opposed hydraulic actuators for moving the boom about its vertical axis and controlling the deceleration of the boom in mid-stroke and at the ends of swing.

DETAILED DESCRIPTION OF THE PREFERRED EMBODIMENT

Figure 1:
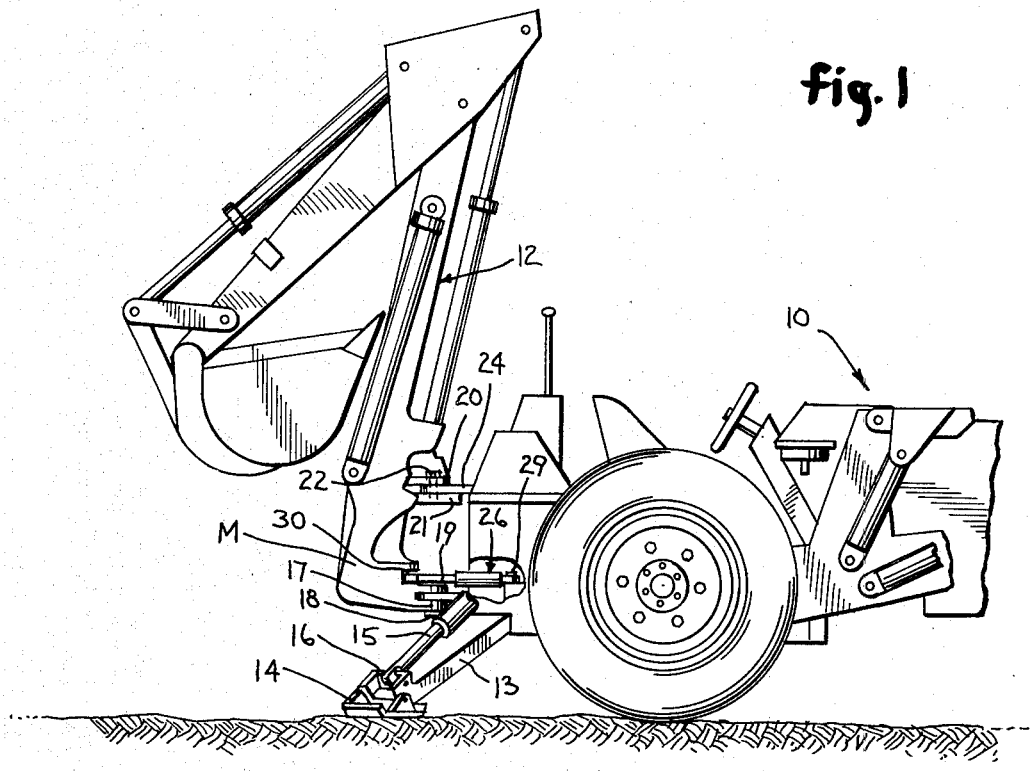

Referring to the drawings and particularly FIG. 1, a tractor 10 is illustrated having its front end broken away, and an articulated backhoe 12 is shown mounted for pivotal movement about a vertical axis on the rear end of the tractor. The rear end of the tractor has outwardly spaced stabilizer arms 13 that are pivotally supported on the tractor frame and carry pivotal feet 14 on their distal ends. Only one such arm 13 and foot 14 are shown in FIG. 1 with the other extending from the left rear side of the tractor. The feet 14 are lowered through the action of actuators 15 pivotally connected at 16 to arms 13. In this manner the rear end of the tractor is stabilized during the operation of the backhoe.

The boom 12 is pivotally supported at its lower end on a mast M pivotally supported about a vertical axis on the tractor by a pair of spaced bosses 17 carried thereby having axially aligned apertures that receive a through pin 18 that also extends through an aperture in boss plate 19 carried by the tractor frame. An upper pivotal support for the backhoe mast M is provided by spaced plates 20 and 21 carried by the mast that flank plate 24 carried by the tractor frame with a vertical pivot pin 22 extending therethrough axially aligned with pivot pin 18. For pivoting the mast M and boom 12 from side to side, a pair of hydraulic actuators 26 and 28 (only actuator 26 is shown in FIG. 1) are provided in opposed relation to one another. The actuators are pivotally connected at one end, such as shown at 29, to the tractor frame and at the other end, such as shown at 30, to the mast M. While actuator 26 is shown in FIG. 1 with the cylinder end connected to the tractor it should be understood that frequently the cylinder end of the actuator is carried by the mast rather than the tractor and the rod end pivotally connected to the tractor. Also, a trunnion mount is commonly used to mount the cylinder end.

Figure 2:
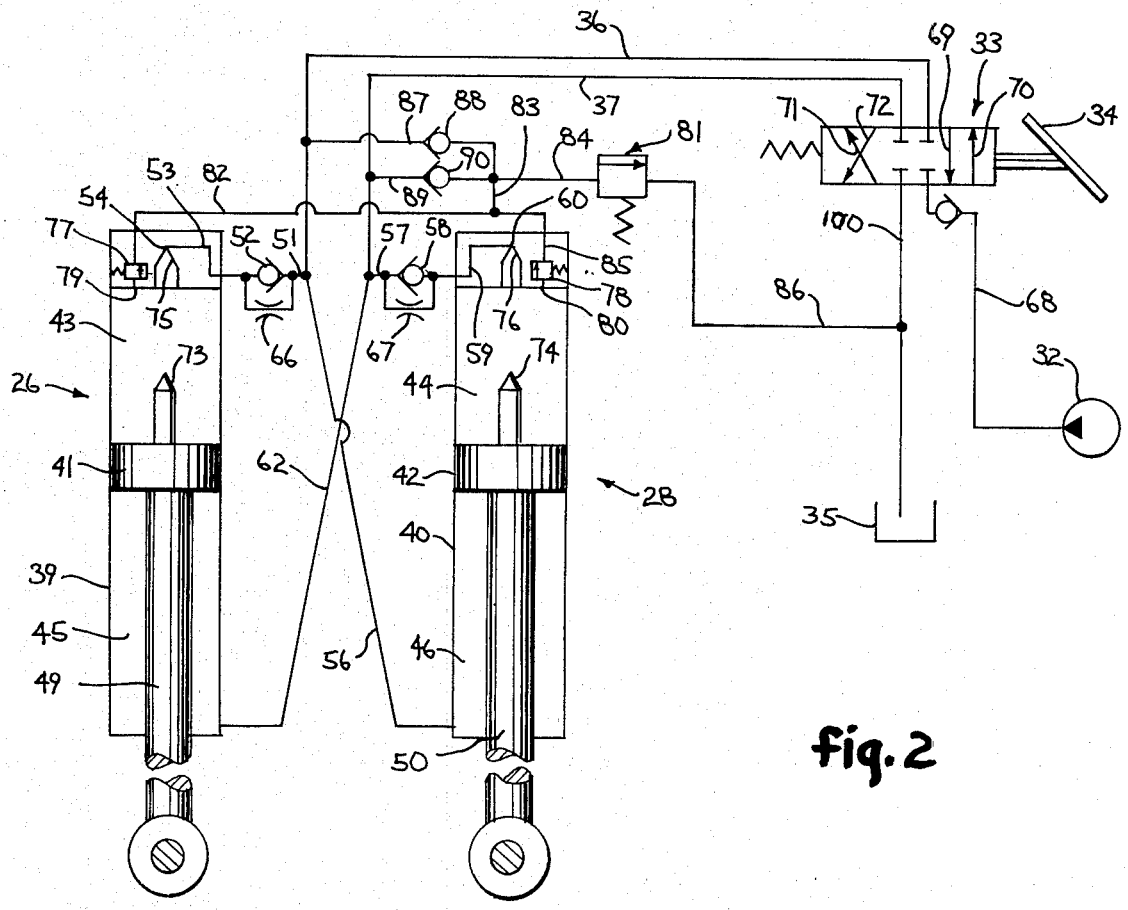

Referring to FIG. 2 the actuators 26 and 28 are double acting hydraulic actuators that selectively receive hydraulic fluid from a fluid pressure source such as pump 32 through a directional control valve 33 positioned by an operator's foot pedal 34 through main hydraulic lines 36 and 37. Control valve 33 selectively connects both sides of each of the actuators 26 and 28 to either high pressure flow from pump 32 or discharge to a suitable reservoir tank 35 through lines 36 and 37.

The hydraulic actuators 26 and 28 include cylinders 39 and 40 having pistons 41 and 42 slidable therein defining in the cylinders head end chambers 43 and 44 and rod end chambers 45 and 46. Pistons 41 and 42 have rods 49 and 50 connected thereto which extend from the cylinders for purposes of driving the external load, which in the present case is the boom 12.

The directional control valve 33 is a three position directional control valve arranged so it drives actuators 26 and 28 in opposite directions so that while one of the actuators tends to push the boom 12 in one direction the other actuator tends to pull the boom in that direction. Toward this end main conduit 36 is connected to convey fluid relative to the head end chamber 43 of cylinder 39 through conduit 51 across one way check valve 52 through line 53 and cylinder passage 54. High pressure line 36 simultaneously conveys fluid to or from the rod end chamber 46 of actuator 28 through line 56 so that the pistons 41 and 42 are driven in opposite directions.

Main line or conduit 37 is connected to deliver fluid to and from the head end chamber 44 of cylinder 40 through line 57 across check valve 58, head end line 59 and head end cylinder passage 60. Main conduit 37 is also connected to convey and discharge fluid simultaneously relative to rod end chamber 45 associated with cylinder 39 through line 62 connected therewith.

Restrictors 66 and 67, respectively, bypass one-way check valves 52 and 58 to permit restricted discharge flow from the head end cylinder chambers 43 and 44.

In the neutral position of the directional control valve 33 shown in FIG. 2, the valve blocks flow either into or out of the main hydraulic lines 36 and 37. When the operator shifts the valve from its neutral position shown to the left, pump 32, through line 68 and valve passage 70 delivers high pressure fluid through line 36 to the head end chamber 43 of actuator 26 across check valve 52, and to the rod end chamber 46 of actuator 28 through line 56. This drives piston 41 associated with actuator 26 downwardly (as shown in FIG. 2) and piston 42 associated with actuator 28 upwardly. At this time fluid discharges from the rod end chamber 45 associated with actuator 26 through line 62, main conduit 37, control valve passage 69, and tank line 100 to tank 35. Fluid discharging from head end chamber 44 associated with actuator 28 flows through head end passage 60, line 59 across restrictor 67, line 57 and into main line 37, which is then connected to tank 35.

In the right-hand position of control valve 33 actuators 26 and 28 are driven in the opposite directions as fluid pressure source line 68 is connected to main conduit 37 through valve passage 71 and main conduit 36 is connected to tank line 100 through valve passage 72. In this position of the valve, high pressure fluid flows through line 37 to the head end chamber 44 associated with actuator 28 across check valve 58 and to the rod end chamber 45 associated with actuator 26 through line 62 driving piston 42 downwardly and piston 41 upwardly. Fluid discharging from head end chamber 43 of actuator 26 passes through passage 54 across restrictor 66 into main conduit 36, which is then the return line, to tank 35. At the same time fluid discharging from rod end chamber 46 associated with actuator 28 expels through line 56 to main conduit 36.

In this manner the operator, by positioning pedal 34, in one of its three positions can drive the actuators in either direction of motion in opposed fashion or block flow relative to the cylinders by placing the control valve 33 in its neutral blocking position when pedal 34 is released.

A deceleration control is provided for cushioning the stopping of the boom 12 as it reaches its extreme limits of travel in each direction. Toward this end, each of the pistons 41 and 42 are provided with an axial projection 73, 74 having conical ends. These projections are frequently referred to as "stingers." The cylinder heads associated with cylinders 39 and 40 have conical recesses 75 and 76 around the head end passages 54 and 60. The projections 73 and 74 are aligned with the conical recesses 75 and 76 so that as the pistons reach their end of the stroke adjacent the head ends of the cylinders the projections 73 and 74 will enter the recesses 75 and 76 and block substantially all discharge flow from the outlet passages 54 and 60.

The cylinder heads of each of the cylinders have a cylinder relief valve 77, 78 that communicates with the head end fluid chamber through a relief port 79, 80. The pressure relief valves 77 and 78 are relatively low pressure relief valves on the order of 1000 psi. Relief valve 77 is in series with a secondary high pressure relief valve 81 through line 82, line 83 and line 84. Similarly, cylinder relief valve 78 is also in series with secondary high pressure relief valve 81 through line 85, line 83 and line 84. The secondary pressure relief valve has a substantially higher pressure setting than relief valves 77 and 78 and is preferably on the order of 2200 psi.

With the directional control valve 33 in its right position conduit 36 will be connected to drain and main conduit 37 will be pressurized driving piston 41 upwardly and piston 42 downwardly. As the piston 41 reaches its end of stroke, projection 73 will enter the conical recess 75 blocking substantially all flow discharging through outlet passage 54 and main conduit 36 which is then the return conduit. This causes a pressure increase in the head end chamber 43 opening the cylinder pressure relief valve 77 porting fluid to the secondary pressure relief valve 81 through lines 82, 83 and 84. With a further increase in pressure in head end chamber 43, pressure relief valve 81 will open porting fluid to tank 35 through line 86. This action provides a substantially constant deceleration for piston 41 along with substantially constant pressure in chamber 43 during deceleration on the order of 3,700 psi without any high peak pressures. Since stopping ability is a function of average pressure, a lower peak pressure will produce the same stop.

If under these conditions the operator attempts to assist the stopping of the boom 12 by releasing pedal 34 and moving valve 33 to its neutral blocking position it will have no effect on the pressure in head end chamber 43 because the main conduit 36 is essentially isolated therefrom under these conditions by the projection 73.

The relief valve 78 in conjunction with secondary relief valve 81 provides a cushioning effect for the actuator 28 as the piston 42 reaches its end of stroke at the head end of cylinder 40 in the same manner as described above with respect to actuator 26.

The secondary relief valve 81 also provides cushioning for the boom 12 as the operator attempts to stop it during mid-stroke between the extreme limits of swing. Toward this end main conduit 36 is connected to the inlet of secondary relief valve 81 through line 87, across check valve 88 into line 84. Check valve 88 prevents reverse flow from the inlet of high pressure valve 81 to main conduit 36. Main conduit 37 is connected to the inlet of secondary relief valve 81 through line 89 across check valve 90 into line 84. Check valve 90 prevents reverse flow from the inlet of the relief valve 81 into main conduit 37. If the operator releases foot pedal 34 in mid-stroke shifting the control valve 33 from its left position to its neutral position shown in FIG. 2, fluid discharging from the actuators through line 37 will be blocked causing an increase in fluid pressure in rod end chamber 45 associated with actuator 26 and head end chamber 44 associated with actuator 28 along with lines 37, 89 and 84. This fluid pressure increase causes secondary relief valve 81 to open permitting fluid to flow through line 89 across check valve 90 through line 86 to tank 35 thereby cushioning the stopping of boom 12.

In similar fashion when control valve 33 is shifted from its right position pressurizing main conduit 37 and discharging main conduit 36 to its neutral position in mid-stroke, fluid discharging through line 36 will be blocked causing an increase in pressure in rod end chamber 46 associated with actuator 28 and head end chamber 43 associated with actuator 26 along with pressure in conduit 36 and lines 87 and 84. When this pressure increases to a predetermined value point secondary relief valve 81 will open permitting fluid to be relieved from conduit 36 to line 87, across check valve 88, through line 84, across the secondary relief valve 81 to tank. In this manner a single secondary relief valve 81 performs the dual function of mid-stroke cushioning in both directions of movement of actuators 26 and 28.

The above circuitry provides a novel but very simple and efficient system for cushioning the movement of a boom during its horizontal swinging movement.

It is, of course, intended to cover by the appended claims all such modifications that fall within the true spirit and scope of the invention.

What is claimed is:

1. In a material handling backhoe with a boom, a hydraulic control circuit for positioning and controlling deceleration of said boom comprising: a hydraulic actuator including a cylinder with a piston slidable therein, a rod connected to the piston extending from the cylinder and operatively connected to said boom, said piston defining first and second opposed expansible and contractible fluid chambers in the cylinder; a manually positionable directional control valve having a neutral first position and second and third positions for porting fluid to stroke the piston in either direction of movement; first conduit means connecting the directional control valve to port fluid to and from the first fluid chamber; second conduit means connecting the directional control valve to port fluid to and from the second fluid chamber; and a deceleration control for cushioning stopping movement of the piston at the end of one of its strokes including (a) restricting means responsive to movement of the piston at the end of one of its strokes for substantially blocking flow through that one of said first and second fluid conduit means which is discharging fluid when the piston is at the end of said one stroke;

(b) relief valve means communicating with that one of said first and second fluid chambers which is contracting during said one stroke of said piston, for relieving fluid pressure by discharging fluid from said one chamber, said relief valve means remaining shut during a substantial portion of the stroke of said piston when said control valve is out of its neutral position;

(c) a relief valve conduit joined to said relief valve means downstream thereof and disposed separately from and by-passing said one conduit means, said relief valve conduit by-passing said directional control valve so that movement of the directional control valve to said neutral position at the end of said one stroke of the piston will increase cylinder pressure only a fraction of that amount the pressure in said cylinder would increase if said relief valve means were disposed to discharge to said one conduit means in parallel with said restricting means;

said relief valve means including a relief port in the contracting one of said chambers disposed separately from the discharging one of said first and second conduit means, a first pressure relief valve communicating with said relief port, and a second pressure relief valve downstream of and in series flow relation with said first pressure relief valve so that as the piston approaches the end of said one stroke, substantially all of the fluid discharged out of said cylinder flows through said relief port whereby the first pressure relief valve and the second pressure relief valve have a cumulative effect in controlling cylinder pressure; and conduit means including one way valve means for interconnecting and providing fluid flow from the first and second fluid conduit means to the second pressure relief valve without cross connecting said first and second conduit means, whereby the second pressure relief valve operates to control piston deceleration when said piston is in mid-stroke if the operator moves the directional control valve to its neutral position.

2. A hydraulic control circuit for controlling the position and deceleration of a boom on a backhoe comprising: a hydraulic actuator operatively connected to said boom for selective movement thereof, said actuator including a cylinder having a piston reciprocable therein, said piston defining first and second fluid chambers in the cylinder; a directional control valve for selectively porting fluid to and from the first and second fluid chambers for reciprocably stroking the piston in the cylinder; first conduit means connected to said directional control valve for conveying fluid to and from the first fluid chamber, second conduit means connected to said directional control valve for conveying fluid to and from the second fluid chamber, said directional control valve having a first position pressurizing said first conduit means and discharging said second conduit means, a second position pressurizing said second conduit means and discharging said first conduit means, and a third position blocking discharge flow from both said first and second conduit means; control means for controlling the deceleration of the piston including a projection carried by the piston for blocking substantially all flow in said first conduit means as the piston reaches the end of one of its strokes; a pressure relief port separately disposed from and by-passing said first conduit means and communicating with the first chamber, a first pressure relief valve communicating with said pressure relief port to receive substantially all flow from the first chamber after the projection blocks flow in said first conduit means so as to assist in decelerating the piston; and a second relief valve downstream of and in series with the first relief valve, whereby fluid is forced to flow through said first and second relief valves at the end of said one stroke in parallel with the fluid flow through said control valve, said first and second relief valves providing a cumulative effect on the deceleration of the piston; wherein the pressure setting on the first pressure relief valve is substantially less than the pressure setting of the second pressure relief valve to reduce peak pressures in the first fluid chamber during deceleration; and third conduit means connecting said first conduit means to the second relief valve, fourth conduit means connecting the second conduit means to the second relief valve, and a check valve in each of said third and fourth conduit means, said check valves respectively permitting flow from the first and second conduit means to the second pressure relief valve and preventing flow from the first pressure relief valve to the first and second conduit means, whereby the second pressure relief valve cushions deceleration before said projection blocks substantially all of the flow through said first conduit means when positioning the directional control valve from its second to its third position.

3. A hydraulic control apparatus comprising: a frame member, a mast member mounted on said frame member for pivotal movement about a vertical axis, a boom mounted on said mast, a first hydraulic actuator including a first cylinder having a first piston reciprocable therein and defining first and second fluid chambers therein, a first rod connected to the first piston and extending from the first cylinder, said first cylinder being pivotally connected to one of said members and said first rod being pivotally connected to the other of said members, a second hydraulic actuator including a second cylinder having a second piston reciprocable therein and defining third and fourth fluid chambers therein, a second rod connected to the second piston and extending from the second cylinder, said second cylinder being pivotally connected to said one member, said second rod being pivotally connected to the other of said members, a tank and source of pressure a directional control valve for selectively porting fluid under pressure from said source to the first, second, third and fourth fluid chambers and for porting return fluid flow from the fluid chambers to said tank to swing the boom from side to side as desired, first conduit means connected to the directional control valve to convey fluid to and from the first and third fluid chambers, second conduit means connected to the directional control valve to convey fluid to and from the second and fourth fluid chambers, said directional control valve having a first position porting fluid under pressure to said first conduit means and discharging fluid from the second conduit means to said tank thereby rotating said mast member in one direction, a second position porting fluid to the second conduit means and discharging fluid from the first conduit means to said tank thereby rotating said mast member in the opposite direction, and a third position blocking said first and second conduit means, deceleration control means for both of said first and second hydraulic actuators operative in one direction of movement of the pistons thereof including a projection associated with the first and second pistons for substantially reducing flow in the first and second conduit means as the first and second pistons approach their end of stroke in said one direction, relief valve means having a predetermined pressure relief setting for relieving pressure in one of said first and fourth fluid chambers as the one of the first and second pistons defining that one chamber approaches the end of its stroke in said one direction, said relief valve means including two cylinder relief valves respectively communicating with each of said first and fourth fluid chambers and disposed on said first and second cylinders separately from the first and second conduit means, said two relief valves normally remaining shut when said pistons are stroked, a high pressure relief valve disposed downstream of and in series flow relationship with each of the two cylinder relief valves, the outlet of said high pressure relief valve being connected to said tank in parallel flow relation with said directional control valve, means to control mid-stroke deceleration of the actuators including third and fourth conduit means for respectively connecting the first and second conduit means to said high pressure relief valve, and means for preventing reverse flow in the third and fourth conduit means to the first and second conduit means, whereby fluid can flow from said first and second cylinders to said high pressure relief valve without flowing through said cylinder relief valves.

* * * * *